US005146846A

United States Patent [19]

Lee et al.

[11] Patent Number: 5,146,846

[45] Date of Patent: Sep. 15, 1992

[54] ROLLER ASSEMBLY FOR GRAIN SHELLERS

[75] Inventors: Stanley M. Lee, Tomball; Jimmy C. Terry, Spring; John A. Mrosko, Katy, all of Tex.

[73] Assignee: F. H. Maloney Company, Houston, Tex.

[21] Appl. No.: 685,921

[22] Filed: Apr. 18, 1991

Related U.S. Application Data

[63] Continuation-in-part of Ser. No. 517,578, May 1, 1990.

[51] Int. Cl.[5] ..... B02B 3/00; B02B 3/04

[52] U.S. Cl. ..... 99/620; 99/574; 99/617; 29/110; 29/132; 100/155 R; 100/176

[58] Field of Search ..... 99/518, 519, 525, 526, 99/574, 617–622, 623; 29/110, 123, 130, 129, 132; 100/176, 155 R; 156/77, 215, 213, 242; 264/156, 273, 274

[56] References Cited

U.S. PATENT DOCUMENTS

| | | | |
|---|---|---|---|
| 160,243 | 2/1875 | Throop | 99/620 |
| 2,651,103 | 9/1953 | Hornbostel | 100/155 R |
| 2,685,548 | 8/1954 | Drozdowski | 154/2.7 |
| 3,239,869 | 3/1966 | Komatsu | 29/110 |
| 3,389,448 | 6/1968 | Buysch | 29/110 |
| 3,626,774 | 12/1971 | Schon | 264/274 |
| 3,779,051 | 12/1973 | Kuesters | 100/176 |
| 3,891,739 | 6/1975 | Lawson | 264/156 |
| 4,066,012 | 1/1978 | Satake et al. | 99/620 |
| 4,293,989 | 10/1981 | Schneider | 29/130 |
| 4,416,201 | 11/1983 | Kessler | 101/348 |
| 4,517,719 | 5/1985 | Okumura et al. | 29/124 |
| 4,522,866 | 6/1985 | Nishikawa et al. | 29/132 |
| 4,576,845 | 3/1986 | Krotchko | 29/110 |
| 4,662,274 | 5/1987 | Nonomiya et al. | 99/620 |
| 4,815,370 | 3/1989 | Collins | 99/618 |

*Primary Examiner*—Timothy F. Simone
*Attorney, Agent, or Firm*—Lorusso & Loud

[57] ABSTRACT

A roller assembly for grain shellers, the assembly including a metal sleeve having locking lugs fixed therein, a sleeve of flexible material bonded to the exterior of the metal sleeve, the locking lugs being adapted for connection to a mounting hub, thereby to fix the metal sleeve to the mounting hub.

13 Claims, 4 Drawing Sheets

ROLLER ASSEMBLY FOR GRAIN SHELLERS

CROSS-REFERENCE TO RELATED APPLICATION

This is a continuation-in-part of application Ser. No. 07/517,578, filed May 1, 1990 in the name of Jimmy C. Terry and John A. Mrosko.

BACKGROUND OF THE INVENTION

1. Field of the Invention

This invention relates to grain shelling apparatus and is directed more particularly to a roller sleeve assembly and roller assembly for rice milling apparatus of the type having twin rollers.

2. Description of the Prior Art

The rice milling process includes a shelling procedure in which the hull, or husk, is removed from the kernel. The shelling procedure follows cleaning the rough rice and serves to remove the course husk from the kernel by use, in most cases, of a set of rubber sheller rolls.

Rubber-surfaced rolls are disposed in parallel with a desired space therebetween and, in operation, are rotated toward each other as rough rice is fed between them. The rollers act to gently remove the husk, leaving the endosperm substantially intact. Thereafter, the kernel may be further refined.

The roll generally employed includes a cast steel or aluminum hub with a rubber surface. The life expectancy of the roll is relatively short, something on the order of less than 100 hours of operation. When a roll has deteriorated to the point at which it requires replacement, the shelling apparatus must be shut down and the rolls removed and replaced. In view of the short life span for rolls, the "down time" of shelling apparatus is a problem.

Accordingly, it would be beneficial to the industry to have available a roll with an improved life expectancy and with a capability for quick and easy replacement.

SUMMARY OF THE INVENTION

An object of the present invention is, therefore, to provide a roller assembly structure in which the milling, or shelling, portions readily may be disassembled from the driving portion and replaced with minimal "down time".

Another object of the invention is to provide a roller sleeve assembly and a roller assembly structure having enhanced cooling capabilities, so as to reduce deterioration of the shelling portions and thereby lengthen the time period between replacements of the shelling portions.

With the above and other objects in view, as will hereinafter appear, a feature of the present invention is the provision of a roller sleeve assembly for grain shellers, the assembly comprising a round tubular rigid metal sleeve, the sleeve having locking lugs fixed therein, the locking lugs extending radially inwardly from an interior surface of the metal sleeve, and a sleeve of flexible material bonded to a lengthwise exterior surface of the metal sleeve, the locking lugs being adapted for connection to a mounting hub.

In accordance with a further feature of the invention there is provided a roller assembly for grain shellers, the assembly comprising a round tubular rigid metal first sleeve, a second sleeve of flexible material bonded to a lengthwise exterior surface of the first sleeve, the first sleeve having locking lugs fixed therein, a mounting hub adapted to slidably receive the first sleeve exteriorly of the hub, a circular wall within the hub and extending widthwise thereof, the wall having holes therein extending axially of the hub, the locking lugs having holes therein adapted to be aligned with the wall holes, whereby the first sleeve is adapted for attachment to the mounting hub by bolting the locking lugs to the hub wall through the locking lug holes and the wall holes.

In accordance with a still further feature of the invention, there is provided a roller assembly for grain shellers, the assembly comprising a round tubular rigid metal first sleeve, a second sleeve of flexible material bonded to a lengthwise exterior surface of the first sleeve, a mounting hub adapted to slidably receive the first sleeve exteriorly of the hub, a wall within the hub and extending widthwise thereof, the mounting hub including a plurality of axially extending ribs which protrude from the wall and slidably receive the first sleeve, and vane means extending from the wall and adapted to create air turbulence within the assembly when in operation.

In accordance with a still further feature of the invention, there is provided a roller sleeve assembly having a flexible sleeve of polyurethane, the polyurethane sleeve having a wall thickness of about 0.375–0.5 inch, the assembly having a metal sleeve of a wall thickness of about 0.312 inch, the polyurethane sleeve being bonded to a lengthwise surface of the metal sleeve and being coextensive with the metal sleeve, the wall thickness of the polyurethane sleeve facilitating rapid transfer of heat to the metal sleeve and thence to the atmosphere.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention from which their novel features and advantages will be apparent.

In the drawings.

DESCRIPTION OF THE PREFERRED EMBODIMENT

Figure 1:
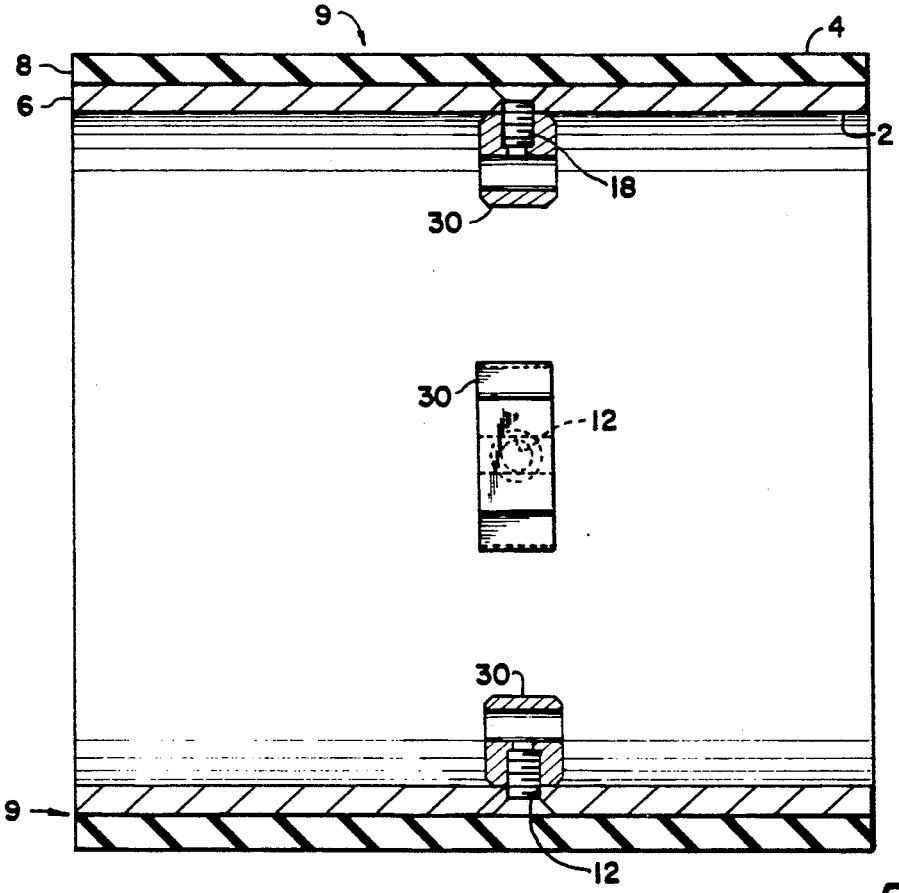
FIG. 1 is a centerline sectional view of one form of a roller sleeve assembly illustrative of an embodiment of the invention.

Referring to FIG. 1 of the drawings, it will be seen that an illustrative embodiment of the invention includes a first round tubular sleeve 2 which is of a rigid material, preferably a metal of high thermal conductivity, such as aluminum. Bonded to the lengthwise exterior surface of the first sleeve 2 is a second sleeve 4 of a hard flexible material, preferably a polymer, such as polyurethane. The two sleeves 2, 4 are coextensive, that is, they are of equal length and precisely aligned such that their respective ends 6, 8 are flush with each other to provide essentially a laminate sleeve assembly 9.

The metal sleeve 2 is provided with counter sunk recesses 12 which extend radially through the metal sleeve. The recesses 12 of the metal sleeve 2 are fitted with threaded flat head screws 18 (FIGS. 1 and 5) extending inwardly of the metal sleeve beyond the interior surface of the metal sleeve. The screw heads are disposed in the counter sunk recesses in the exterior surface of the metal sleeve. The recesses 12 are closed at one end by the interior surface of the second sleeve 4, thereby capturing the screws 18.

In fabrication of the sleeve assembly 9, the counter sunk recesses 12 are drilled radially through the metal sleeve 2. The screws 18 are then inserted in the recesses 12 and locking lugs 30 are threadedly connected to the screws 18. In bonding the flexible material sleeve 4 to the metal sleeve 2, the recessed heads of the screws 18 are covered by flow of the flexible material thereover. Upon completion of the bonding step, the screws 18 are securely fixed to the metal sleeve 6.

Figure 2:
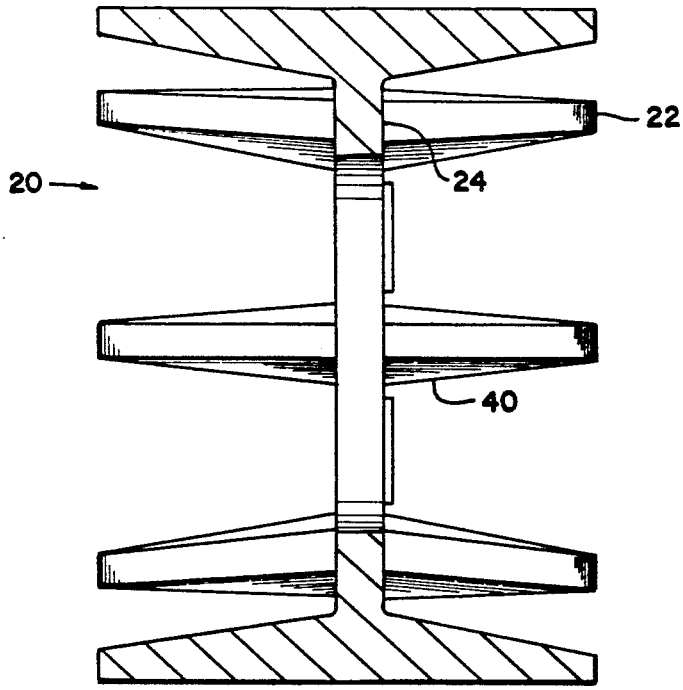
FIG. 2 is a centerline sectional view of a hub component of a roller assembly illustrative of an embodiment of the invention.
Figure 3:
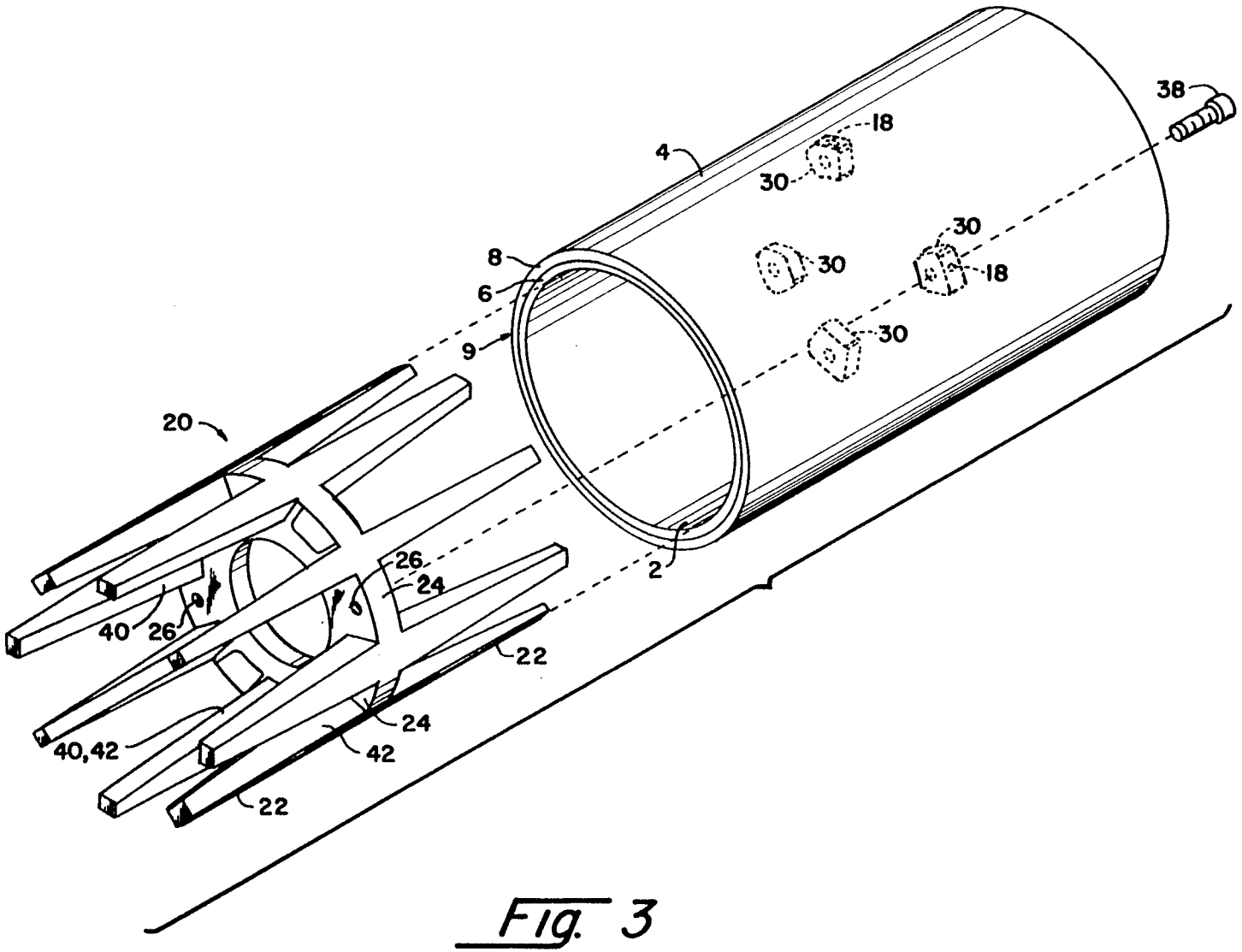
FIG. 3 is an exploded perspective view showing a roller assembly including the components shown in FIGS. 1 and 2.
Figure 5:
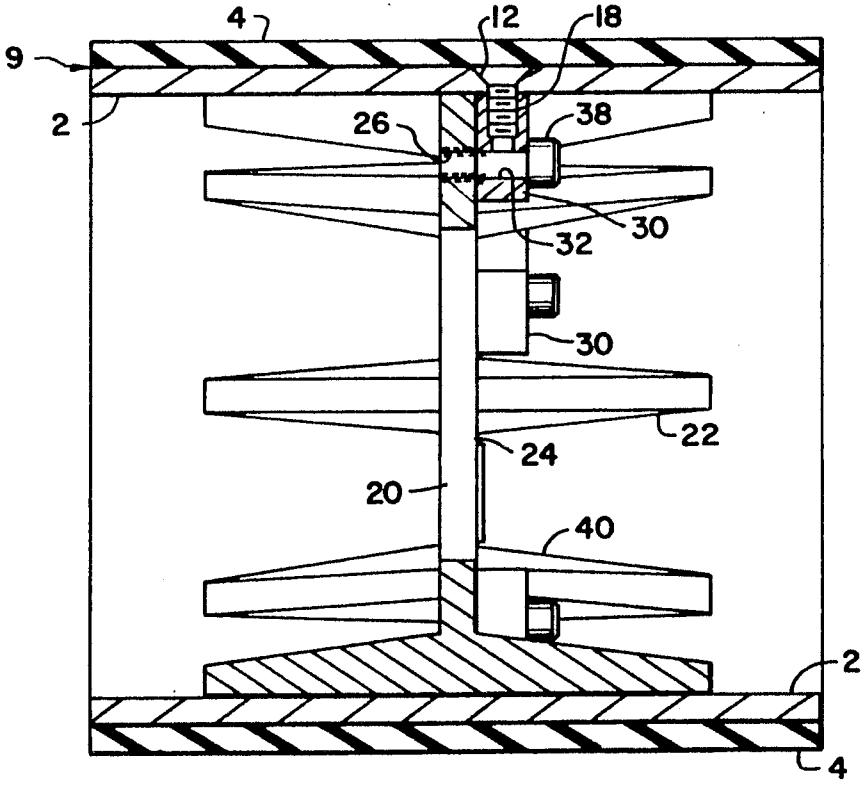
FIG. 5 is a sectional view taken along line V—V of FIG. 4.
Figure 4:
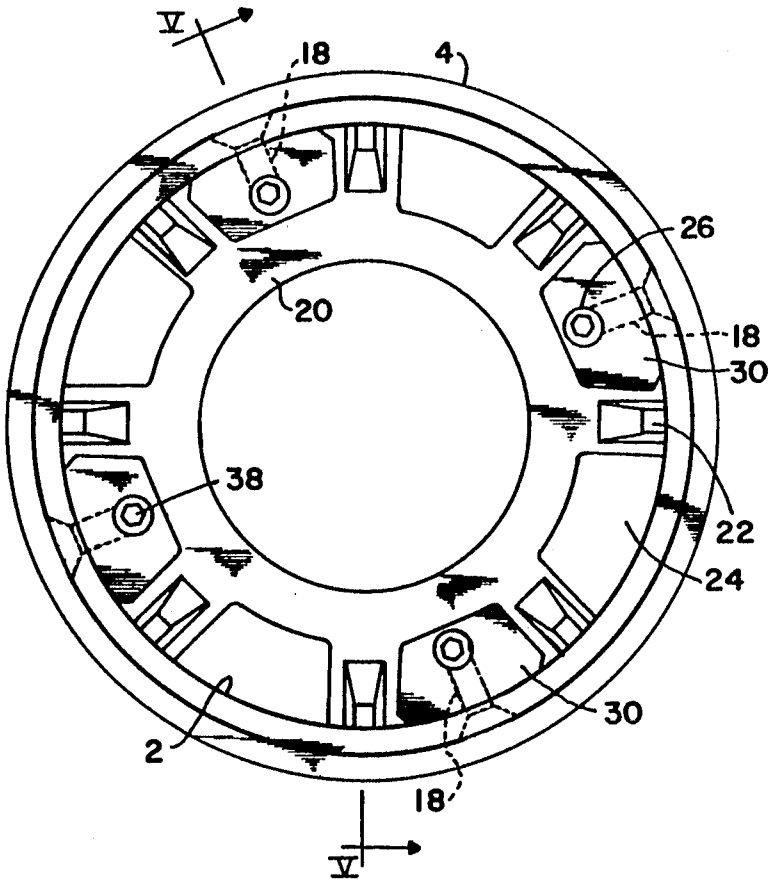
FIG. 4 is an end view of the roller assembly of FIG. 3.
Figure 6:
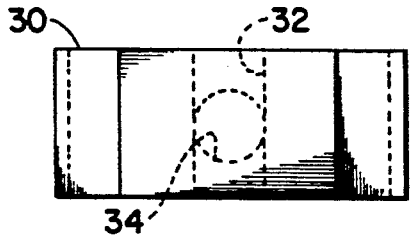
FIG. 6 is a top view of a locking lug for the roller sleeve assembly.
Figure 7:
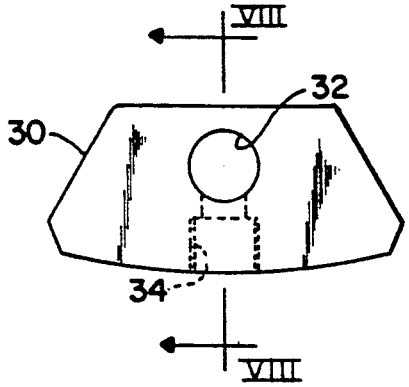
FIG. 7 is a front elevational view of the locking lug shown in FIG. 6.
Figure 8:
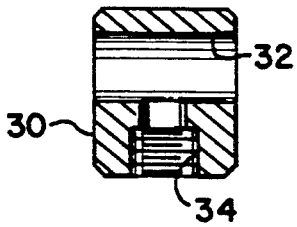
FIG. 8 is a sectional view of the locking lug, taken along line VIII—VIII of FIG. 7.

The mounting means comprises a mounting hub 20 (FIGS. 2 and 3) having a series of ribs 22 extending from a circular, and preferably annular, wall 24. The ribs 22 are arranged in a spaced circular configuration so as to be adapted to slidably receive the metal sleeve 2 exteriorly of the ribs 22 (FIG. 3). The wall 24 extends widthwise and substantially normally of the axially extending ribs. The wall 24 is provided with axially extending holes 26 (FIGS. 3-5).

The afore-mentioned locking lugs 30 (FIGS. 1, 3-5) are adapted to lock the metal sleeve 2 to the wall 24. The locking lugs 30 are provided with holes 32 adapted for alignment with the wall holes 26 (FIG. 5). The locking lugs 30 may be connected to the wall 24 by bolts 38 extending through the locking lug holes 32 and the wall holes 26 (FIGS. 3 and 5). Thus secured, the sleeve assembly 9 is fixed to the mounting hub 20 such that there can be no longitudinal or rotational movement of the sleeves relative to the hub.

As noted above, the ribs 22 protrude axially from the wall 24 and define a circumference adapted to slidably receive the metal sleeve 2. As such, the ribs 22 serve as a critical part of the mounting hub, the part upon which the sleeve 2 is mounted. The ribs 22 are formed so as to perform a second valuable function. One or more of the ribs 22 are provided with a shaped portion 40 (FIG. 3) increasing the area of the rib and providing vane means 42 internally of the assembly. In rotation of the sleeve assembly, the vane means 42 operate to create air turbulence centrally of the assembly, to assist in cooling the metal sleeve 2 and the flexible sleeve indirectly by cooling of the metal sleeve. In the embodiment illustrated, the vane means 42 extend from the wall 24 and the ribs 22. However, it will be apparent that the vane means 42 could comprise surfaces extending from the wall 24 or the ribs 22 and independent of the other.

In operation, when the flexible sleeve has deteriorated to the point at which replacement is required, the roller assembly is stopped. The bolts 38 are withdrawn from the holes 26, 32 and the locking lugs 30 and worn sleeve assembly 9 are slid off the mounting hub 20. A new sleeve assembly, complete with locking lugs, is then slid onto the ribs 22 of the mounting hub and the holes 26, 32 are aligned. A bolt 38 is inserted in the holes 26, 32 and secured therein. The process is repeated for each locking lug, taking only a few seconds per lug. The process is then repeated for the other roller assembly of a twin roller assembly and the apparatus is ready to resume operations.

In use of the aforementioned prior art rubber-surfaced rolls, it has been the custom to have the rubber sleeves of a relatively large (about one inch) wall thickness, in the expectation that because of rapid wear a wall thickness of an inch, or more, will provide substantial longevity before wearing out of the roll surface. However, it has been determined that a contributing factor to rapid wear of the rubber sleeves is the heat generated at the roll surface, which heat is not readily dissipated. It has been discovered that longevity can be enhanced by making the outer sleeve 4 of polyurethane and, rather than having a relatively thick walled sleeve, provide a relatively thin walled sleeve. The thin walled polyurethane sleeve 4 conducts heat rapidly to the metal sleeve 2 and thence to the atmosphere.

It has been found that a polyurethane sleeve thickness of about 0.5 inch, used in conjunction with an aluminum metal sleeve having a wall thickness of about 0.312 inch, provides a heat conduction rate in BTU/hour approximately twice the heat conduction rate of a one inch rubber sleeve used in conjunction with the same metal sleeve. A polyurethane sleeve having a wall thickness of 0.375 inch increases the heat conduction rate to almost three times that of the prior art one inch sleeve. The thinner sleeves, with higher heat conduction rates, actually provide increased life expectancy of the rolls, rather than a decreased active period, as has generally been believed.

Accordingly, using the above-described vane means 42 in conjunction with the increased cooling capacity as a result of providing a relatively thin-walled flexible outer sleeve 4, contributes to a long-lived roller sleeve assembly 9 which substantially increases the life of the roller assembly. When replacement does fall due, the above-described locking lugs 30 offer quick and easy replacement.

It is to be understood that the present invention is by no means limited to the particular constructions herein disclosed and/or shown in the drawings, but also comprises any modifications or equivalents within the scope of the claims.

Having thus described our invention, what we claim as new and desire to secure by Letters Patent of the United States is:

1. A roller sleeve assembly for grain shellers, said assembly comprising a round tubular rigid first sleeve, said first sleeve having locking lugs fixed to said first sleeve by screws, and a second sleeve of flexible material bonded to an exterior surface of said first sleeve, with heads of said screws disposed in recesses in an exterior surface of said first sleeve, an interior surface of said roller assembly second sleeve closing an end of each of said recesses, thereby covering each of said screw heads, said locking lugs extending radially inwardly of said first sleeve and being adapted for connection to a mounting means.

2. The roller sleeve assembly in accordance with claim 1 in which said first sleeve and said second sleeve are coextensive.

3. A roller sleeve assembly in accordance with claim 1 in which said second sleeve of flexible material is a polyurethane sleeve having a wall thickness of about 0.375 to 0.5 inch.

4. A roller sleeve assembly in accordance with claim 1 in which said first metal sleeve is of aluminum and has a wall thickness of about 0.3 inch.

5. A roller assembly for grain shellers, said assembly comprising a round tubular rigid metal first sleeve, said first sleeve having locking lugs fixed therein extending radially inwardly of said first sleeve, a second sleeve of flexible material bonded to an exterior surface of said first sleeve and covering heads of screws fixing said locking lugs to said first sleeve, said locking lugs being adapted for connection to a mounting means, said mounting means comprising a mounting hub adapted to slidably receive said first sleeve exteriorly of said hub, a wall in said hub having holes extending axially of said hub, said locking lugs having holes therein adapted to be aligned with said wall holes, whereby said first sleeve is adapted for attachment to said mounting hub by fixing said locking lugs to said hub wall through said locking lug holes and said wall holes.

6. The roller assembly in accordance with claim 5 in which said mounting hub includes a plurality of axially extending ribs which slidably receive said first sleeve.

7. The roller assembly in accordance with claim 6 in which said wall is of an annular configuration.

8. A roller assembly in accordance with claim 7 and further comprising vane means extending internally of said hub and adapted to create air turbulence within said assembly when in operation.

9. The roller assembly in accordance with claim 5 in which said first and second sleeves are coextensive.

10. The roller assembly in accordance with claim 8 in which said ribs extend from said annular wall to define a circumference adapted to slidably receive said first sleeve, and said vane means comprise portions of said ribs extending inwardly of said assembly.

11. The roller assembly in accordance with claim 5 in which each of said locking lugs comprises a rigid block with one of said locking lug holes extending therethrough from a first substantially planar face to a second substantially planar face, and a threaded recess retaining one of said screws, said threaded recess extending from an arcuate end surface of said locking lug toward and normal to said locking lug hole.

12. A roller assembly in accordance with claim 5 in which said second sleeve of flexible material is a polyerethane sleeve having a wall thickness of about 0.375 to 0.5 inch.

13. A roller sleeve assembly in accordance with claim 5 in which said metal sleeve is of aluminum and has a wall thickness of about 0.3 inch.

* * * * *